United States Patent [19]

Bardsley et al.

[11] Patent Number: 4,676,096

[45] Date of Patent: Jun. 30, 1987

[54] DOWNHOLE RESETTABLE FORMATION SAMPLING TOOL

[75] Inventors: Frank B. Bardsley, Andover; David E. Stoddart, Stroud, both of England

[73] Assignee: Gearhart Tesel, Ltd., Basingstoke, England

[21] Appl. No.: 791,347

[22] Filed: Oct. 25, 1985

[51] Int. Cl.[4] ..... E21B 47/00

[52] U.S. Cl. ..... 73/155; 166/100

[58] Field of Search ..... 73/155, 152, 151; 166/264, 100

[56] References Cited

U.S. PATENT DOCUMENTS

| | | | |
|---|---|---|---|
| 3,253,654 | 5/1966 | Briggs, Jr. et al. | 166/100 |
| 3,430,698 | 3/1969 | Urbanosky | 166/100 |
| 3,577,782 | 5/1971 | Aitken | 73/155 |
| 3,952,588 | 4/1976 | Whitten | 73/155 |
| 4,210,018 | 7/1980 | Brieger | 73/155 |
| 4,246,782 | 1/1981 | Hallmark | 73/155 |
| 4,507,957 | 4/1985 | Montgomery et al. | 166/100 |

*Primary Examiner*—Stewart J. Levy
*Assistant Examiner*—Scott M. Oldham
*Attorney, Agent, or Firm*—Hubbard, Thurman, Turner & Tucker

[57] ABSTRACT

A tool for use downhole has means (18, 19, 20, 44) for engaging materials surrounding the hole. The engagement means (18, 19, 20, 44) are operated by hydraulic pressure controlled by a hydraulic circuit (10). A hydraulic power module (11) is provided for varying hydraulic pressure in the hydraulic circuit (10) to effect movement of the engagement means (18, 19, 20, 44). In case of failure, a dumping assembly (17) is provided to allow relief of hydraulic pressure in the circuit (10). The dumping assembly (17) includes a dump chamber (62) of variable volume, a dump valve (60) and a non-return valve (61); the hydraulic circuit being capable of being re-set downhole after dumping, there being no need to bring the tool to the surface.

14 Claims, 2 Drawing Figures

DOWNHOLE RESETTABLE FORMATION SAMPLING TOOL

BACKGROUND OF THE INVENTION

The invention relates to tools for use downhole in, for example, testing formations.

Formation testing tools of this type are designed to take samples of the formation surrounding a drilled hole so that the nature of the formation can be ascertained. In general, such tools are hydraulically operated, hydraulic power being generated by an electric motor, since electrical power is the only feasible source of power which can be carried long distances downhole.

A problem arises on existing formation testing tools in that, if there is a power failure while the tool is being operated, some means of relieving hydraulic pressure used to force, for example, a probe into the surrounding formation is needed otherwise the tool will be permanently jammed in the hole.

Hitherto, formation testing tools have provided a hydraulic dumping chamber to relieve hydraulic pressure, but once dumped, the system cannot be reset without bringing the tool to the surface. This is clearly inconvenient and costly in both time and money.

SUMMARY OF THE INVENTION

According to the invention, there is provided a tool for use downhole, which tool has means for engaging material surrounding the hole, hydraulic means including a hydraulic circuit for moving the engagement means into and out of engagement with said surrounding material, means for varying hydraulic pressure in said hydraulic circuit to effect said movement, and means for allowing dumping of hydraulic fluid in the event of the pressure varying means being inoperative, the dumping means allowing restoration of hydraulic fluid to the hydraulic circuit upon further operation of the pressure varying means.

The dumping means preferably comprises a fluid-tight dumping chamber of variable volume.

There is preferably valve means controlling flow of hydraulic fluid into and out of the dumping chamber.

The valve means preferably comprises in parallel a dump valve and a non-return valve, which non-return valve allows fluid out of but not into the dumping chamber. The valve means preferably has means for keeping the dump valve closed during normal operation, and means for opening the dump valve when the pressure varying means becomes inoperative.

The means for keeping the valve closed during normal operation is preferably a solenoid, such that in the event of a break in electrical supply to the tool, the dump valve is opened.

Delay means are preferably provided for delaying opening of the dump valve for a predetermined period after the pressure varying means becomes inoperative. The delay means may be mechanical, for example a spring operated catch, or hydraulic, for example a restrictor. Alternatively, an independent electrical line may be provided to allow an operator to open the dump valve at will.

The means for opening the dump valve when the pressure varying means becomes inoperative is preferably resilient means, preferably a spring, acting, in use, on the dump valve.

The engaging means preferably includes a probe for engaging the material surrounding the hole, which probe has conduit means for allowing certain material surrounding the hole to be introduced into the tool for testing purposes and probe valve means for opening and closing the conduit.

The probe is preferably extendable by means operable by pressure in the hydraulic circuit.

The probe is preferably mounted on a packer, and the packer is preferably movable into and out of the tool by means operable by pressure in the hydraulic circuit.

Sequencing valve means are preferably provided for operating the tool in the sequence of extending the packer, then extending the probe, then opening the probe conduit.

PREFERRED EMBODIMENT OF THE INVENTION

By way of example, one embodiment of a tool according to the invention will now be described with reference to the accompanying drawings, which illustrates a hydraulic circuit for a tool.

Figure 1:
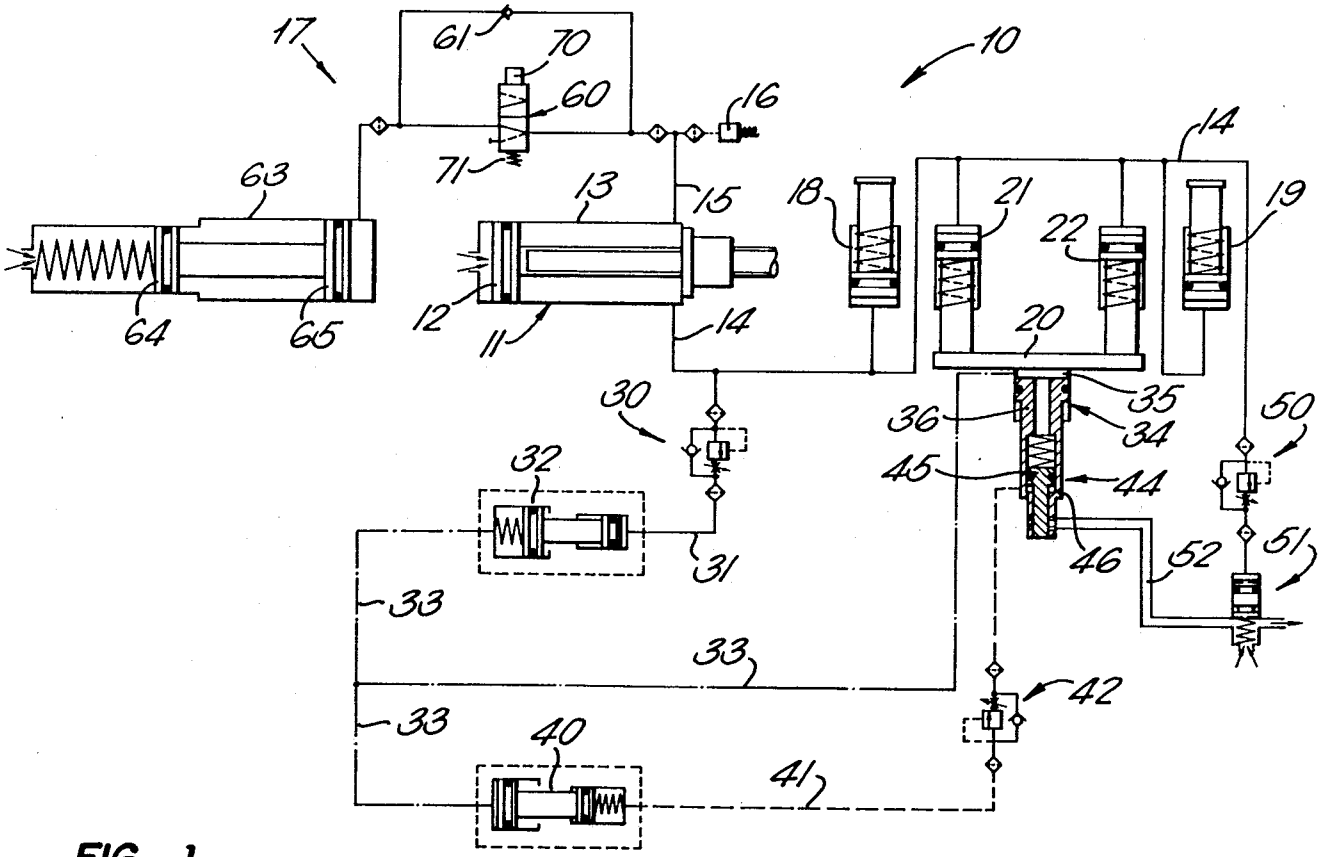
In FIG. 1, there is illustrated the hydraulic actuating circuit of the formation testing tool.
Figure 2:
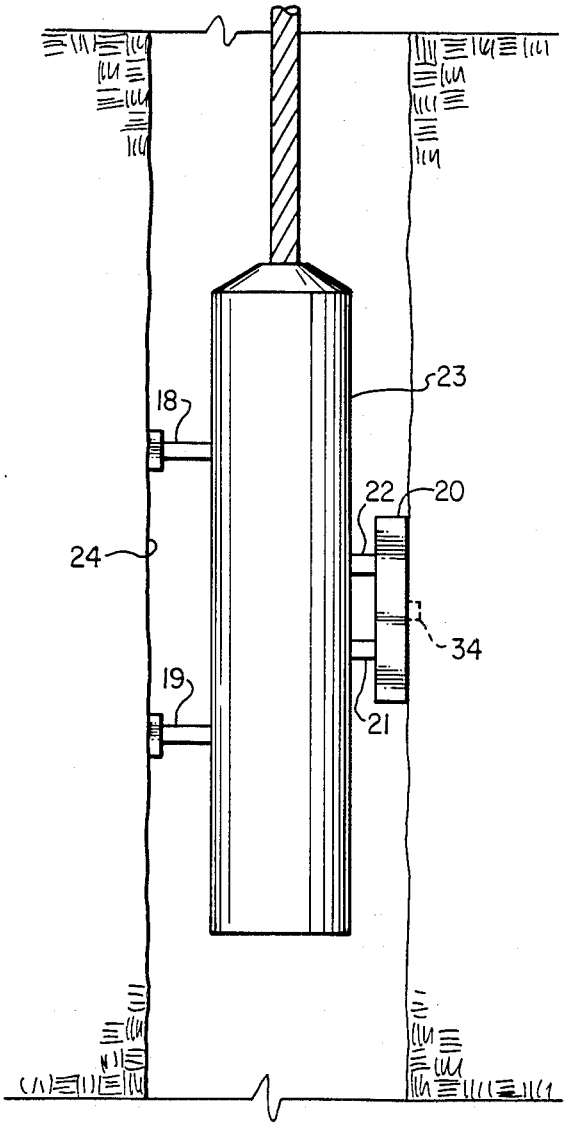
In FIG. 2, there is illustrated the formation testing tool in its intended environment.

A formation testing tool according to the invention includes a hydraulic circuit as illustrated in FIG. 1. The circuit will be housed in an elongate body 23 designed to fit down a borehole, as shown in FIG. 2.

The hydraulic circuit is balanced against mud pressure and pressures referred to in the following description are pressures in excess of mud pressure.

Hydraulic fluid in the circuit 10 is pressurised by means of a hydraulic power module 11. In this particular embodiment, the hydraulic power module has a piston 12 operating in a cylinder 13, movement of the piston 12 being controlled by a ball screw and electric motor which is powered electrically by a current cabled down from the surface. Operation of the ball screw and electric motor moves the piston 12 along the cylinder 13. As can be seen in FIG. 1, the piston 12 is balanced on its side remote from the hydraulic circuit against mud pressure.

Two hydraulic lines 14 and 15 extend from the hydraulic power module, line 15 to a pressure sensor 16 and a dumping assembly generally indicated at 17 (to be described later) and line 14 leading to the operational elements of the tool.

Upon operation of the hydraulic power module, hydraulic pressure in the line 14 builds up and first operates a pair of backup jacks 18 and 19 together with a packer assembly 20 mounted on a pair of rams 21 and 22. The jacks 18 and 19 and the rams 21 and 22 are all balanced against mud pressure. The hydraulic pressure causes the rams 21 and 22 to extend to force outwardly the packer 20 towards the formation 24 and the reaction of the tool is taken by the backup jacks 18 and 19, as shown in FIG. 2.

Once the jacks 18 and 19 and the rams 21 and 22 are extended, the pressure increases until a predetermined pressure is reached, for example, 4,000 pounds per square inch over mud pressure, at which time a first sequencing valve generally indicated at 30 is opened. The sequencing valve 30 allows fluid in a line 31 beyond the sequencing valve 30 to pressurize to the predetermined pressure and a hydraulic reducer 32 immersed in oil at mud pressure causes a reduction in pressure beyond the reducer to a predetermined secondary pressure, for example 1,500 pounds per square inch. The secondary pressure extends over lines 33 which are indicated in chain dot lining in the drawing. The line 33 branches and one branch leads to a probe 34 mounted on the packer 20. The probe 34 includes a cylinder 35 and piston 36 and the secondary pressure in the line 33 causes the piston to be forced along the cylinder 35 to extend the probe to engage formation 24, as shown in FIG. 2. It is quite possible for the reducer 32 to be omitted.

Once the piston 36 has been extended, the pressure in the secondary line again builds up and, via a hydraulic intensifier 40 immersed in oil at mud pressure to cause an increase in pressure beyond it, for example to 3,000 pounds per square inch over mud pressure, in line 41 indicated in chain line from the drawing, a second sequencing valve 42 is operated. Operation of the second sequencing valve 42 allows the pressure in the line 41 to reach a filter valve 44 including a piston 45 and cylinder 46 to draw the piston 45 into the probe and thereby open the filter valve.

When the filter valve 44 is open, pressure again increases and a third sequencing valve 50 is operated from the original hydraulic line 14 to close a mud equalising valve generally indicated at 51 to open an inlet line 52 for fluid to flow into the tool 10 from the surrounding material. The fluid flows through the filter valve 44 past the mud equalising valve 51, and into the tool for testing or sampling.

As happens not infrequently, supply of electricity to the tool may be cut off accidentally. Without electricity, the hydraulic power module 11 cannot be operated to withdraw the probe 34, packer 20 and jacks 18 and 19 as would be normal. It is essential, therefore, to provide means for dumping the hydraulic fluid to allow quick release of the probe 34 packer 20 and jacks 18 and 19 to free the tool from engagement with the surrounding material.

In the past, such a dumping arrangement has consisted merely of a sealed chamber into which hydraulic fluid is allowed to pass upon electrical failure. In order to reset the tool, it has always been necessary to bring the tool to the surface.

In this embodiment of a tool, resetting is possible downhole by the dumping assembly 17 referred to earlier.

The hydraulic line 15 from the hydraulic power module 11 leads to a dump valve 60 in parallel with a non-return valve 61. The dump valve is operated by a solenoid 70 such that, when electrical power is provided, the dump valve is kept closed. When electrical power is cut off, the solenoid cannot operate and the dump valve 60 is opened, being forced to the open position by a spring 71. This allows the hydraulic fluid to flow to a dump chamber which includes a cylinder 63 and a pair of connected pistons 64 and 65. The piston 64 is balanced against mud pressure and is of smaller diameter than the piston 65. Thus, hydraulic fluid at a significant pressure over mud pressure has no difficulty in forcing the piston 65 along the cylinder 63 to relieve the pressure in hydraulic circuit, the space between the pistons 64 and 65 being filled with gas, conveniently air at atmospheric pressure, to allow easy compression of the space between the pistons 64 and 65 as the connected pistons move to the left in the drawing. In doing so, the probe valve 44 is closed, the probe is withdrawn towards the packer 20, the packer 20 is withdrawn and the backup jacks 18 and 19 are withdrawn.

To avoid dumping when the power failure is only brief, a delay means is included. The delay means may be mechanical, for example a spring operated catch on the solenoid movement, or hydraulic, for example a restriction in a hydraulic line. Alternatively, an independent power line, battery operated, may be provided for the solenoid, to allow a surface operator independent control of the dump valve solenoid 70.

When electrical power is restored to the tool 10, the dump valve solenoid is energised to close the dump valve 60 and operation of the hydraulic power module 11 in a direction to reduce hydraulic pressure will draw out the fluid from the dump chamber via the non-return valve 61. Further operation of the hydraulic power module 11 to pressurise the system is then possible.

The aforegoing description has been described in relation to a formation testing tool, but it will be appreciated that a dumping feature according to the invention providing for downhole resetting may be used on any other tool which requires hydraulic pressure to operate.

It will also be appreciated that various modifications may be made to the embodiment described, the scope of the invention being defined by the appended claims.

We claim as our invention:

1. A tool for use downhole, which tool has means for engaging material surrounding the hole, hydraulic means including a hydraulic circuit for moving the engaging means into and out of engagement with said surrounding material, means for varying hydraulic pressure in said hydraulic circuit to effect said movement, means for allowing dumping of hydraulic fluid in the event of the pressure varying means being inoperative, and means for restoring hydraulic fluid to the hydraulic circuit when the tool is downhole and remote from an operator by further operation of the pressure varying means, whereby the tool may continue to function after dumping of hydraulic fluid without the need for the tool to be brought to the surface, pressure in the hydraulic circuit being balanced against pressure outside the tool such that the hydraulic pressure varying means creates a pressure difference in the hydraulic circuit to move said engaging means, the dumping means comprising dump valve means and a dumping chamber including a dump piston slidable therein and a compensating chamber and a compensating piston slidable therein acted on by pressure outside the tool, the dump piston and the compensating piston being linked to move one with the other and the dump piston being of larger cross sectional area than the compensating piston whereby, when the dump valve means are operated to dump hydraulic fluid, the hydraulic fluid urges back the dump piston against the force exerted by external pressure on the compensating piston and when the hydraulic fluid is to be restored to the hydraulic circuit by operation of the hydraulic pressure varying means, the dump piston is forced back to empty the dump chamber.

2. A tool as claimed in claim 1 comprising means for delaying operation of the dumping means in the event of the pressure varying means being inoperative.

3. A tool as claimed in claim 2 wherein the delay means are mechanical.

4. A tool as claimed in claim 2 wherein the delay means are hydraulic.

5. A tool as claimed in claim 2 wherein the delay means are electrical.

6. A tool as claimed in claim 5 wherein the dumping means are electrically controlled, and an independent electrical supply is provided for the dumping means to allow independent control thereof from the surface.

7. A tool as claimed in claim 1 wherein the dump valve means comprises in parallel a dump valve and a non-return valve, which non-return valve allows fluid out of but not into the dumping chamber.

8. A tool as claimed in claim 7 wherein the dump valve means has means for keeping the dump valve closed during normal operation, and means for opening the dump valve when the pressure varying means becomes inoperative.

9. A tool as claimed in claim 8 wherein the means for keeping the dump valve closed during normal operation is a solenoid, the arrangement being such that in the event of a break in electrical supply to the tool, the dump valve is opened.

10. A tool as claimed in claim 8 wherein the means for opening the dump valve when the pressure varying means becomes inoperative is resilient means acting, in use, on the dump valve.

11. A tool as claimed in claim 1 wherein the engaging means includes a probe for engaging the material surrounding the hole, which probe has conduit means for allowing certain materials surrounding the hole to be introduced into the tool for testing purposes and probe valve means for opening and closing the conduit.

12. A tool as claimed in claim 11 when the probe is extendable by means operable by pressure in the hydraulic circuit.

13. A tool as claimed in claim 12 wherein the probe is mounted on a packer, the packer being moveable into and out of the tool by means operable by pressure in the hydraulic circuit.

14. A tool as claimed in claim 13 comprising sequencing valve means for operating the tool in the sequence of extending the packer, then extending the probe, then opening the probe conduit.

* * * * *